US009198475B2

(12) United States Patent
Park

(10) Patent No.: US 9,198,475 B2
(45) Date of Patent: Dec. 1, 2015

(54) WAIST GIRTH ADJUSTER AND TROUSERS HAVING SAME

(76) Inventor: Hae Oh Park, Seoul (KR)

( * ) Notice: Subject to any disclaimer, the term of this patent is extended or adjusted under 35 U.S.C. 154(b) by 669 days.

(21) Appl. No.: 13/496,331

(22) PCT Filed: Sep. 14, 2010

(86) PCT No.: PCT/KR2010/006286
§ 371 (c)(1),
(2), (4) Date: Apr. 5, 2012

(87) PCT Pub. No.: WO2011/034333
PCT Pub. Date: Mar. 24, 2011

(65) Prior Publication Data

US 2012/0233743 A1 Sep. 20, 2012

(30) Foreign Application Priority Data

Sep. 15, 2009 (KR) ..... 10-2009-0086840

(51) Int. Cl.
*A41F 9/02* (2006.01)
*A41F 9/00* (2006.01)
*A41F 1/00* (2006.01)

(52) U.S. Cl.
CPC . *A41F 9/00* (2013.01); *A41F 1/008* (2013.01); *A41F 9/025* (2013.01)

(58) Field of Classification Search
CPC ..... A41F 1/008; A41F 9/025; Y10S 24/48
USPC ..... 2/237; 24/587.12, 590.1, 578.1
See application file for complete search history.

(56) References Cited

U.S. PATENT DOCUMENTS

| | | | | | |
|---|---|---|---|---|---|
| 1,965,315 | A | * | 7/1934 | Mainzer | 2/237 |
| 2,077,002 | A | * | 4/1937 | Moyer et al. | 2/237 |
| 2,438,933 | A | * | 4/1948 | Markin | 2/237 |
| 2,626,397 | A | * | 1/1953 | Lewis | 2/237 |
| 2,888,729 | A | * | 6/1959 | Lethern et al. | 24/587.12 |
| 3,204,253 | A | * | 9/1965 | Sato | 2/237 |

(Continued)

FOREIGN PATENT DOCUMENTS

| | | | |
|---|---|---|---|
| CN | 1282554 | A | 2/2001 |
| CN | 1301510 | A | 7/2001 |

(Continued)

OTHER PUBLICATIONS

English Language Abstract of CN 1846551 A.

(Continued)

*Primary Examiner* — Richale Quinn
(74) *Attorney, Agent, or Firm* — Hershkovitz & Associates, PLLC; Abe Hershkovitz

(57) ABSTRACT

Disclosed are a waist girth adjustor which can flexibly adjust a waist girth according to various body types of a wearer wearing trousers, and a pair of trousers having the same. The waist girth adjustor installed in inner and outer overlapping portions formed by separably cutting away one or more portions of a waist band of a pair of trousers to adjust a waist girth of the trousers, comprises: a guide rail sewn in the inner overlapping portion transversely and having a latch on an upper part thereof and a boss protruding along a lengthwise direction of one side that contacts with the inner overlapping portion; and a position fixing unit including a movable member having a first insertion portion such that the movable member is slidably coupled to the guide rail, a pressing piece rotatably coupled to one side of the movable member about a hinge shaft and resiliently supported by the side of the movable member to be caught by and fixed to the latch, and a fixing member coupled to one side of the movable member such that the movable member is fixed to and installed in the outer overlapping portion.

5 Claims, 4 Drawing Sheets

(56) References Cited

U.S. PATENT DOCUMENTS

| | | | | | |
|---|---|---|---|---|---|
| 3,703,729 | A | * | 11/1972 | Hinderer | 2/237 |
| 3,797,046 | A | * | 3/1974 | Hoch | 2/237 |
| 3,835,473 | A | * | 9/1974 | Toyoda | 2/237 |
| 3,956,802 | A | * | 5/1976 | Kanzaka | 24/590.1 |
| 3,988,812 | A | * | 11/1976 | Kanzaka | 24/590.1 |
| 4,545,096 | A | * | 10/1985 | Belter et al. | 24/587.12 |
| 4,578,827 | A | * | 4/1986 | Appelt | 2/221 |
| 4,780,939 | A | * | 11/1988 | Belter et al. | 24/578.15 |
| 4,945,616 | A | * | 8/1990 | Okano | 24/593.1 |
| 4,976,017 | A | * | 12/1990 | Frano | 24/578.1 |
| 5,774,952 | A | * | 7/1998 | Ito | 24/578.15 |
| 5,926,927 | A | * | 7/1999 | Winkler | 24/593.1 |

FOREIGN PATENT DOCUMENTS

| | | | |
|---|---|---|---|
| CN | 1846551 | A | 10/2006 |
| JP | 2002-112806 | A | 4/2002 |
| JP | 2007-154368 | A | 6/2007 |
| KR | 10-0656591 | B1 | 6/2006 |
| KR | 10-2006-0105636 | A | 10/2006 |
| KR | 10-0885850 | B1 | 2/2009 |
| KR | 20-0444929 | Y1 | 6/2009 |

OTHER PUBLICATIONS

English Language Abstract of CN 1282554 A.

English Language Abstract of CN 1301510 A.

English Language Abstract of JP 2002-112806 A.

English Language Abstract of JP 2007-154368 A.

English Language Abstract of KR 10-2006-0066700 a which is an application publication of KR 10-0656591 B1.

English Language Abstract of KR 10-0885850 B1.

English Language Abstract of KR 10-2006-0105636 A.

* cited by examiner

WAIST GIRTH ADJUSTER AND TROUSERS HAVING SAME

TECHNICAL FIELD

The present invention relates to a waist girth adjustor and a pair of trousers having the same, and more particularly, to a waist girth adjustor which can flexibly adjust a waist girth according to various body types of a wearer wearing the trousers, and a pair of trousers having the same.

BACKGROUND ART

In general, various sizes of trousers are being manufactured to be worn by various wearers whose body types are all different.

As the waist girths of the trousers are fixed when the trousers are manufactured, when body conditions of wearers change, for example, waist girths of growing youths are continuously changed, their trousers need to be altered or they should purchase a new pair of trousers of different size to accommodate for the change in size of their bodies.

Even if the body conditions do not change, if the wearer gains weight around the waist, the trousers may press the stomach due to the fixed waist girth.

A technology for flexibly adjusting a waist girth of a pair of trousers according to body conditions of a wearer has been disclosed to solve the above-mentioned problem.

FIG. 1 is a view showing a configuration of a pair of trousers whose waist girth can be adjusted according to the conventional art.

Referring to FIG. 1, a pair of trousers whose waist girth can be adjusted according to the conventional art has a structure where an inner overlapping portion 13 and an outer overlapping portion 14 are separated from each other, and a boss plate 21, installed transversely between the inner overlapping portion 13 and the outer overlapping portion 14, is coupled to a fixing member 30.

However, in the above-mentioned configuration where the boss plate 21 and the fixing member 30 are coupled to each other to adjust a waist girth, a space S between the inner overlapping portion 13 and the outer overlapping portion 14 expands due to a structural defect of the boss plate 21. Accordingly, wrinkles may be caused while the trousers are worn, making the clothes look untidy, for example, the trousers are disheveled.

Further, since a pressing piece 34 of the fixing member 30 is installed on the inner side of the trousers, it is inconvenient for the wearer to adjust the waist girth of the trousers.

DISCLOSURE

Technical Problem

The present invention has been made in an effort to provide a waist girth adjustor which can flexibly adjust a waist girth according to various body types of wearer wearing the trousers and can be attached tightly to inner and outer overlapping portions of a waist band, and a pair of trousers having the same.

Technical Solution

An exemplary embodiment of the present invention provides a waist girth adjustor, installed in inner and outer overlapping portions formed by separably cutting away one or more portions of a waist band of a pair of trousers to adjust a waist girth of the trousers, comprising: a guide rail sewn in the inner overlapping portion transversely and having a latch on an upper part thereof and a boss protruding along a lengthwise direction of one side that contacts with the inner overlapping portion; and a position fixing unit including a movable member having a first insertion portion such that the movable member is slidably coupled to the guide rail, a pressing piece rotatably coupled to one side of the movable member about a hinge shaft and resiliently supported by the side of the movable member to be caught by and fixed to the latch, and a fixing member coupled to one side of the movable member such that the movable member is fixed to and installed in the outer overlapping portion.

A guide groove is formed along a lengthwise direction on the other side of the guide rail to be easily sewn to the inner overlapping portion.

The latch has a unidirectional saw-like shape and the pressing piece is caught by and fixed to the latch in only one direction.

Another exemplary embodiment of the present invention provides a pair of trousers having a waist girth adjustor, comprising: inner and outer overlapping portions formed to overlap each other by separably cutting away one or more portions of a waist band of a pair of trousers: a guide rail sewn in the inner overlapping portion transversely and having a latch on an upper part thereof and a boss protruding along a lengthwise direction of one side that contacts with the inner overlapping portion; and a position fixing unit including a movable member having a first insertion portion such that the movable member is slidably coupled to the guide rail, a pressing piece rotatably coupled to one side of the movable member about a hinge shaft and resiliently supported by the side of the movable member to be caught by and fixed to the latch, and a fixing member coupled to one side of the movable member such that the movable member is fixed to and installed in the outer overlapping portion.

The inner and outer overlapping portions are formed by cutting away pocket bands at both opposite sides of the trousers, respectively.

Both ends of a cover cloth are sewn and fixed to the waist band such that the guide rail is not exposed to the outside, and the movable member has a second insertion portion serving as a movement passage for the cover cloth.

Advantageous Effects

According to the present invention, a pressing piece is installed at an upper side of a waist band to easily manipulate a waist girth adjustor and the waist girth adjustor is attached tightly to the inner and outer overlapping portions to prevent a pair of trousers from being wrinkled, making the clothes look neat.

<Reference Numeral List>

Figure 1:
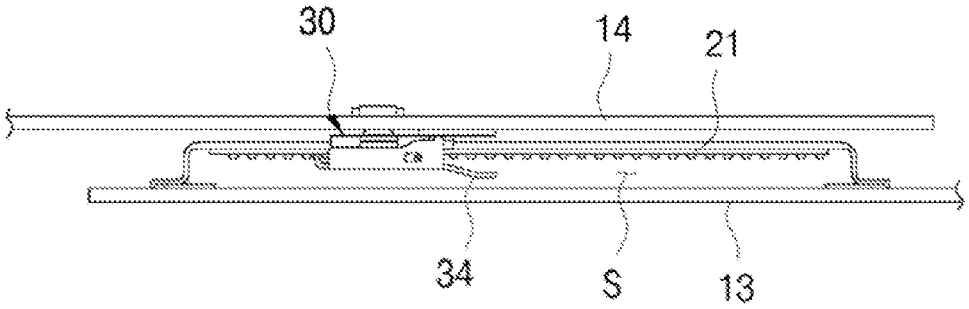
FIG. 1 PRIOR ART
FIG. 1 is a view showing a configuration of a pair of trousers whose waist girth can be adjusted according to the conventional art.

| | |
|---|---|
| 100: Trousers | 101: Waist band |
| 106: Pocket band | 110: Inner overlapping portion |
| 120: Outer overlapping portion | |
| 210, 310: Guide rail | |
| 211: Latch | 213: Boss |
| 230, 330: Position fixing unit | |
| 231: Movable member | |
| 231a, 331a: First insertion portion | |
| 231b, 331b: Second insertion portion | |
| 235, 335: Pressing piece | |
| 238: Fixing member | |
| 250: Cover cloth | |

BEST MODE

Hereinafter, a configuration and an operation of exemplary embodiments of the present invention will be described in detail with reference to the accompanying drawings.

Here, it is noted that in assigning reference numerals to the elements of the drawings, the same elements are denoted by the same reference numerals even though they appear in different drawings.

Exemplary Embodiment 1

Figure 2:
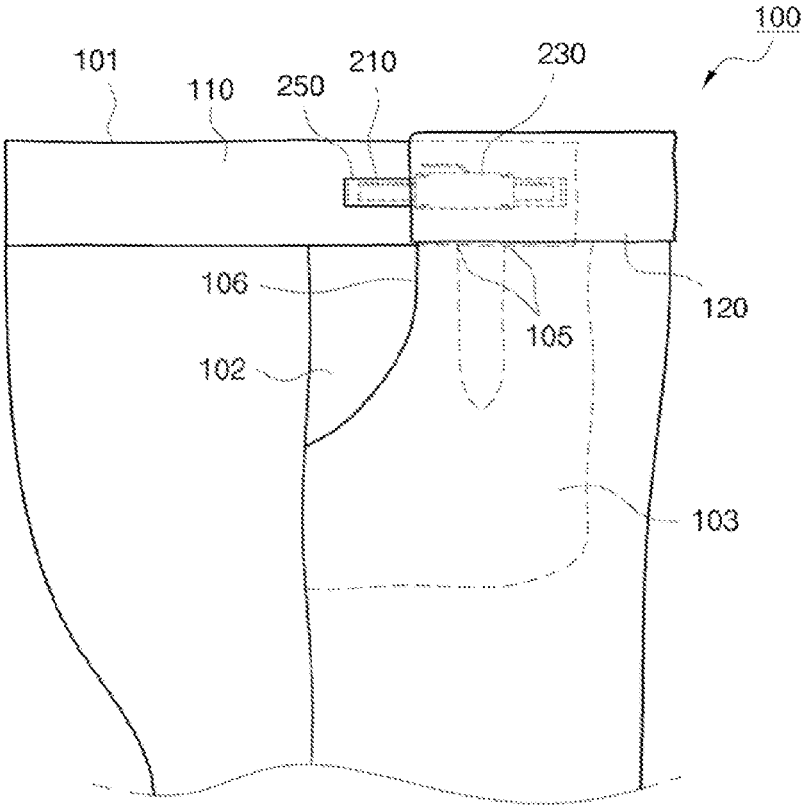
FIG. 2 is a side view of a pair of trousers having a waist girth adjustor according to the present invention.
Figure 3:
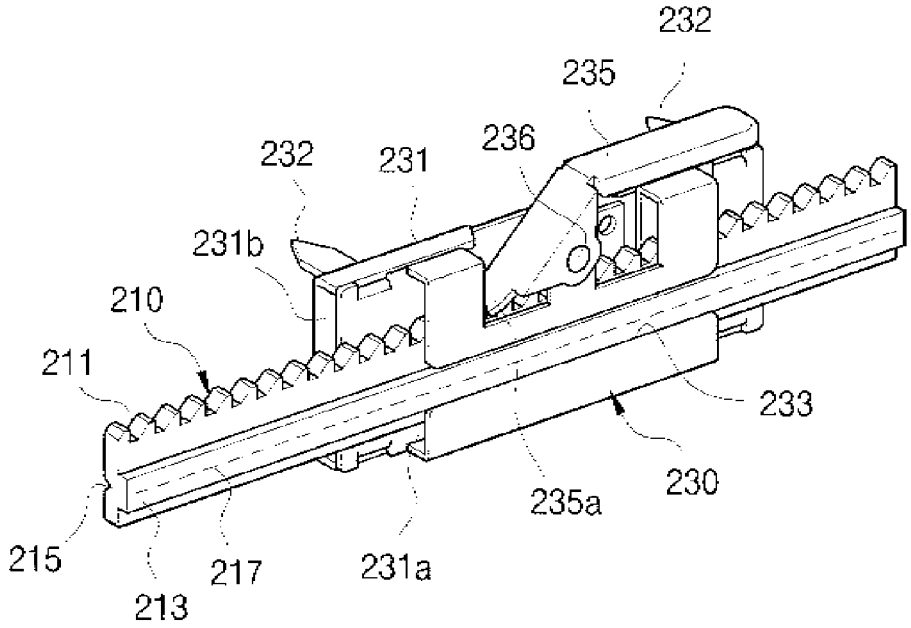
FIG. 3 is a perspective view of the waist girth adjustor according to the present invention.
Figure 4:
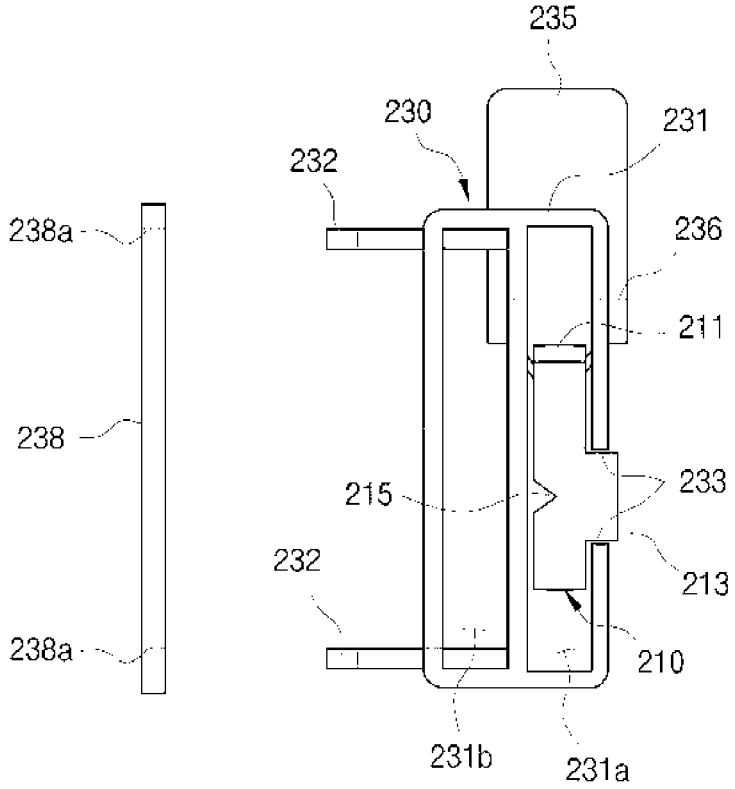
FIG. 4 is a side sectional view of the waist girth adjustor according to the present invention.

FIG. 2 is a side view of a pair of trousers having a waist girth adjustor according to the present invention. FIG. 3 is a perspective view of the waist girth adjustor. FIG. 4 is a side sectional view of the waist girth adjustor.

Referring to FIG. 2, a pair of trousers 100 according to an exemplary embodiment of the present invention comprises an overlapping part formed at a waist band 101 such that one or more portions of the waist band 101 is separably cutaway to overlap each other. In this case, the overlapping part includes an inner overlapping portion 110 coupled to an inner side 102 of a pocket and an outer overlapping portion 120 coupled to an outer side 103 of the pocket. The inner overlapping portion 110 and the outer overlapping portion 120 are separated from each other, and linings 105 in the pocket are connected to the inner overlapping portion 110 and the outer overlapping portion 120 to be spaced apart from each other by a predetermined width. The inner and outer overlapping portions 110 and 120 have the same configurations as the conventional art.

In this case, the inner and outer overlapping portions 110 and 120 are formed by cutting away pocket bands 106 at both opposite sides of the trousers, respectively.

Here, the waist girth adjustor 200 according to the exemplary embodiment of the present invention, which is installed between the inner and outer overlapping portions 110 and 120 to be tightly attached to a connecting portion of the inner and outer overlapping portions 110 and 120 to make the clothes look neat, comprises a guide rail 210 and a position fixing unit 230.

A detailed description of the configuration of the present invention is as follows.

Figure 5:
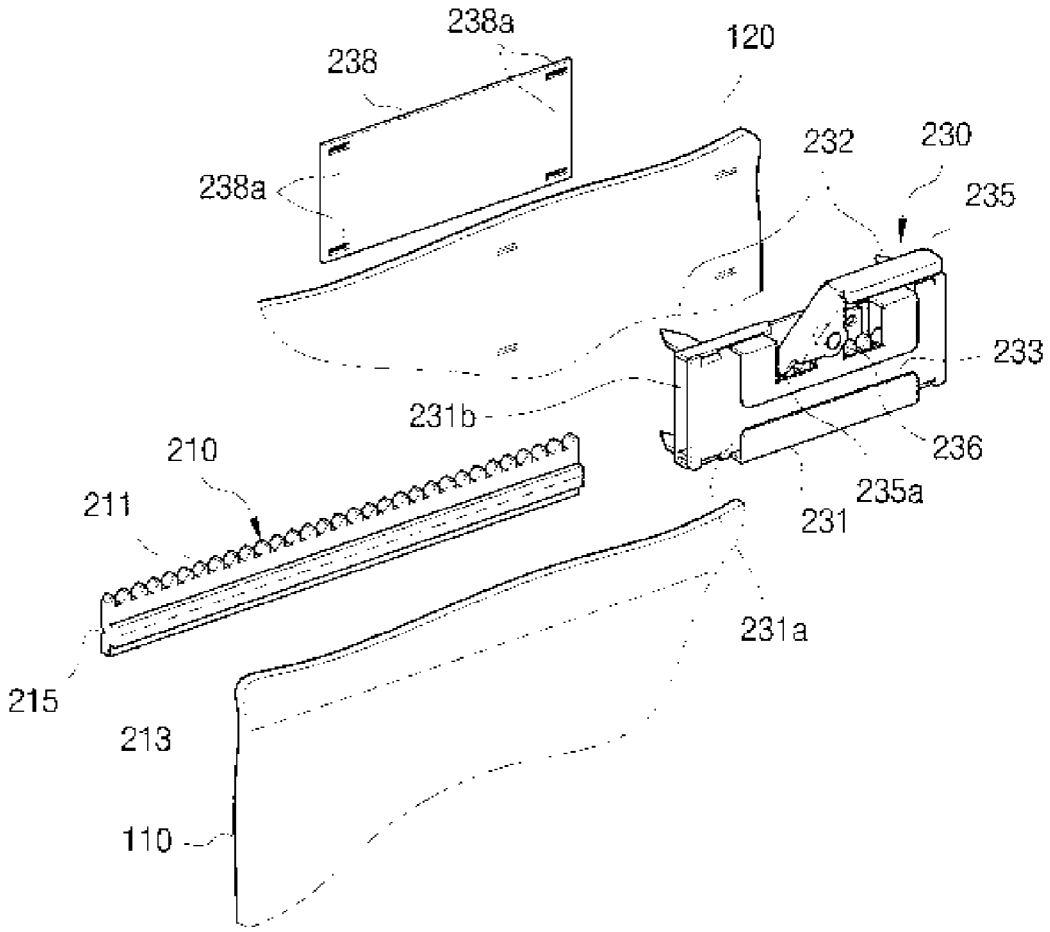
FIG. 5 is a view showing an installation state of the waist girth adjustor according to the present invention.

Referring to FIGS. 3 to 5, the guide rail 210 is sewn transversely to one side of the inner overlapping portion 110 (see FIG. 2) to be fixed, and a unidirectional saw-like latch 211 is formed on an upper part of the guide rail 210.

In this case, a boss 213 for guiding the position fixing unit 230 to be slidably coupled to the guide rail 210 protrudes from one side of the guide rail 210 that contacts with the inner overlapping portion 110, and a guide groove 215 for guiding the guide rail 210 to be easily sewn to the inner overlapping portion 110 is formed on the other side of the guide rail 210 along a sewing line 217.

In this case, the boss 213 and the guide groove 215 are located at central portions of the guide rail 210 to prevent the guide rail 210 from being inclined to one side. That is, the sewing line 217 is formed in the boss 213.

The position fixing unit 230 is slidably coupled to the guide rail 210 while one side thereof is fixed to the outer overlapping portion 120, and the position fixing unit 230 adjusts a waist girth of the trousers 100 while reciprocating right and left of the waist band 101.

The position fixing unit 230 includes a movable member 231 slidably coupled to the guide rail 210, a pressing piece 235 rotatably coupled to an upper side of the movable member 231 about a hinge shaft 236 and caught by and fixed to the latch 211, and a fixing member 238 for fixing and installing the movable member 231 in the outer overlapping portion 120.

In this case, a first insertion portion 231*a* is formed in the movable member 231 so that the guide rail 210 can be inserted thereinto, and a slit 233 is formed at one side of the first insertion portion 231*a* so that the boss 213 of the guide rail 210 can be slidably coupled thereto.

Also, a resilient spring (not shown) resiliently supporting the pressing piece 235 to one side is mounted on the hinge shaft 236, so that a catching portion 235*a* is caught by the latch 211 when a force pressing the pressing piece 235 is released. In this case, the latch 211 has a unidirectional saw-like shape, so that the catching portion 235*a* of the pressing piece 235 is caught and fixed only in one direction.

Further, a plurality of insertion pins 232 are formed on the other side of the movable member 231 to be inserted into and coupled to corresponding insertion holes 238*a* of the fixing member 238 with the outer overlapping portion 120 being interposed therebetween. In this case, after the insertion pins 232 are inserted into the insertion holes 238*a*, a portion of the fixing member 238 protruding to the outside is bent toward and tightly attached to the fixing member 238, and then the installation of the position fixing unit 230 is completed.

The fixing member 238 is desirably inserted into the outer overlapping portion 120 before the outer overlapping portion 120 is completely sewn so as not to be exposed to the outside.

Meanwhile, the waist band 101 further includes a cover cloth 250 for covering the guide rail 210 to prevent the guide rail 210 from being exposed to the outside. The cover cloth 250 has a shape corresponding to the guide rail 210, and both ends thereof are sewn and fixed.

In this case, a second insertion portion 231*b* serving as a movement passage for the cover cloth 250 is formed in the movable member 231 to prevent the cover cloth 250 from interfering with the reciprocation of the movable member 231. Accordingly, the movable member 231 can be smoothly reciprocated along a lengthwise direction of the guide rail 210 and the cover cloth 250.

In this case, the cover cloth 250 is formed of a cloth with the same material and color as those of the waist band 101 to conceal the guide rail 210 when the guide rail 210 is viewed from the outside.

Figure 6:
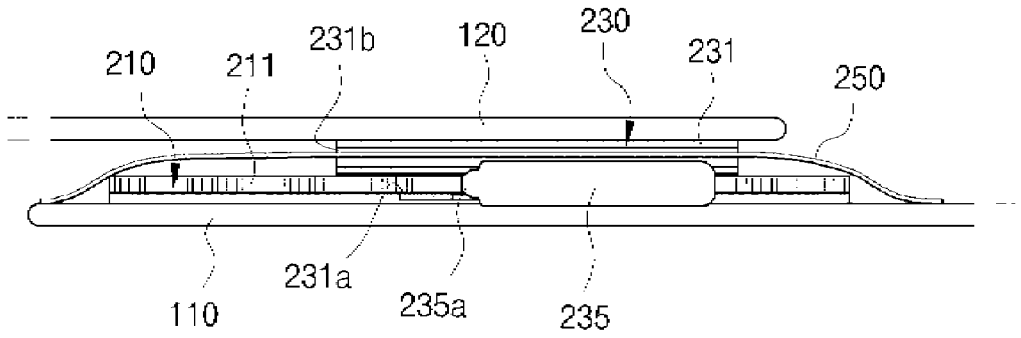
FIG. 6 is a plan view of the trousers having the waist girth adjustor according to of the present invention.

Next, a method of adjusting a waist girth of a pair of trousers 100 having the waist girth adjustor 200 according to the present invention will be described with reference to FIG. 6.

First, when the waist girth is to be adjusted while the trousers 100 is worn, the pressing pieces 235 of the position fixing units 230 installed in the vicinity of the pocket bands 106 at both opposite sides of the trousers 100 are pressed.

The pressing piece 235 can be smoothly moved in one direction (reducing the waist girth) due to the unidirectional saw-like shape of the latch 210, whereas the catching portion 235*a* of the pressing piece 235 is caught by a vertical portion of the latch 210 in an opposite direction (increasing the waist girth).

In order to increase the waist girth of the trousers 100, the pressing operation of the pressing piece 235 is released after the movable member 231 is moved by pressing the pressing piece 235 straight, and then the pressing piece 235 returns by a resilient force and the catching portion 235*a* is caught by the latch 211 to be fixed.

Although an example where the waist girth adjustor 200 according to the present invention is installed at one side of the trousers has been shown and described until now, two waist girth adjustors 200 are installed at pocket bands 106 of both opposite sides of the trousers 100 to be symmetrical to each other.

Further, a case where the guide rail 210 is installed in the inner overlapping portion 110 and the position fixing unit 230 is installed in the outer overlapping portion 120 has been exemplified, but they may be installed in an opposite way.

Exemplary Embodiment 2

Figure 7:
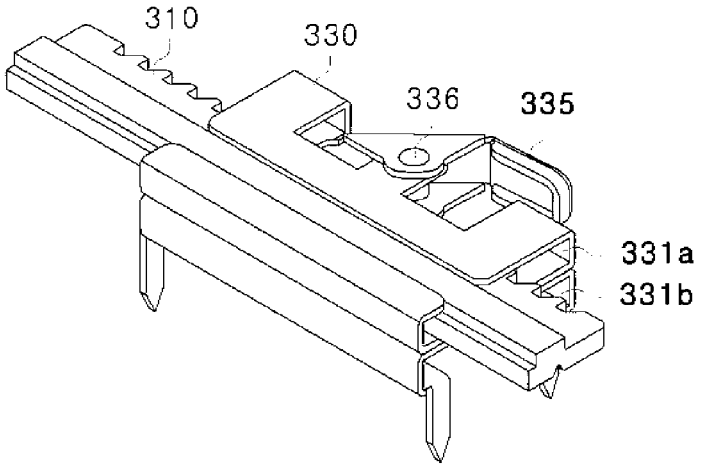
FIG. 7 is a perspective view of a waist girth adjustor according to another embodiment of the present invention.
Figure 8:
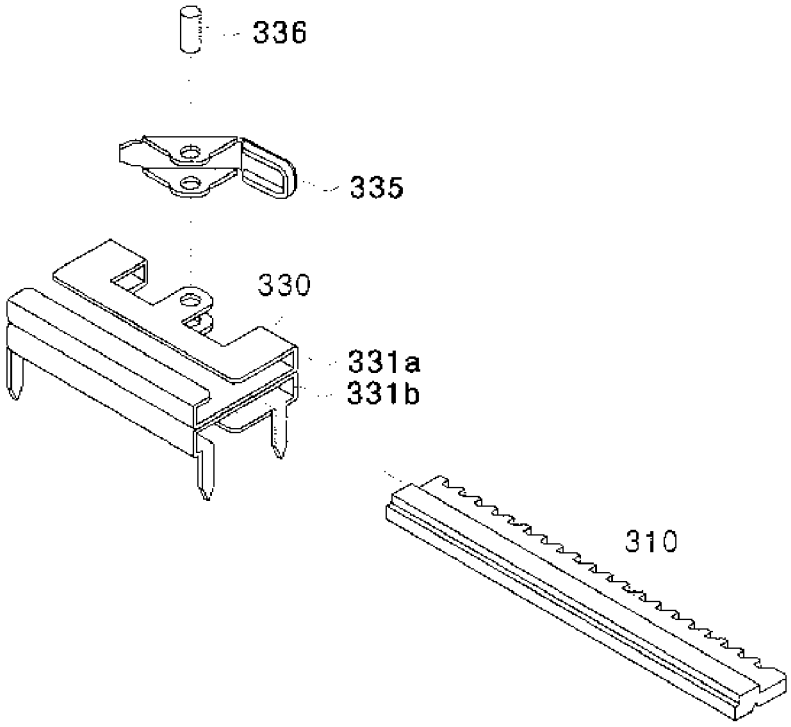
FIG. 8 is an exploded perspective view of the waist girth adjustor shown in FIG. 7.

Referring to FIGS. 7 and 8 showing another exemplary embodiment of the present invention, like in the first exemplary embodiment, a waist girth adjustor comprises a guide rail 310, a position fixing unit 330, a pressing piece 335, and a hinge shaft 336. The different feature of the second exemplary embodiment from the first exemplary embodiment lies in that the sizes of the guide rail 310 and the position fixing unit 330 are reduced to make the waist girth adjustor smaller. In detail, unlike the above-described first exemplary embodiment, a first insertion portion 331*a* and a second insertion portion 331*b* of the position fixing unit 330 according to the present exemplary embodiment are located on the same plane, and accordingly an overall size of the waist girth adjustor is reduced.

The operation principle and the method of fixing the waist girth adjustor to trousers are the same as those of the above-described first exemplary embodiment, so a detailed description thereof will be omitted.

Although it has been described that the waist girth adjustor according to the present invention is applied to a pair of trousers, the waist girth adjustor can also be applied to a skirt. Further, it is apparent that various modifications can be made by a skilled person in the art to which the present invention pertains without departing from the scope of the present invention.

The invention claimed is:

1. A waist girth adjustor installed in inner and outer overlapping portions formed in a waist band of a pair of trousers to adjust a waist girth of the trousers comprising:

a guide rail having an upward protruding latch formed along a lengthwise direction on an upper surface thereof and a boss protruding on a first surface that is at a right angle with the upper surface and in a first direction that is perpendicular to the first surface; and a position fixing unit including:

a movable member having a first insertion portion to which the guide rail is inserted such that the movable member is slidably coupled to the guide rail, a slit to which the boss is slidably coupled being formed on one side of the movable member that is facing the first surface of the guide rail which is inserted into the first insertion portion, and a second insertion portion arranged side by side with the first insertion portion with a partition between the first insertion portion and the second insertion portion and through which a cover cloth covering the guide rail, to prevent the guide rail from being exposed outside, can pass through, a pressing piece rotatably coupled to an upper side of the movable member about a hinge shaft having an axial direction identical to the first direction and resiliently supported by the upper side of the movable member to be caught by and fixed to the latch, and a fixing member coupled to one side of the movable member.

2. The waist girth adjustor of claim 1, wherein a guide groove is formed along a lengthwise direction on an opposite side of the first surface of the guide rail.

3. The waist girth adjustor of claim 1, wherein the latch has a unidirectional saw-like shape and the pressing piece is caught by and fixed to the latch only in one direction.

4. A pair of trousers having a waist girth adjustor, comprising: inner and outer overlapping portions formed in a waist band of a pair of trousers:

a guide rail sewn in the inner overlapping portion transversely with an upward protruding latch formed along a lengthwise direction on an upper surface thereof and a boss protruding on a first surface that is at a right angle with the upper surface and in a first direction that is perpendicular to the first surface and in contact with the inner overlapping portion; and a position fixing unit including:

a movable member having a first insertion portion to which the guide rail is inserted such that the movable member is slidably coupled to the guide rail, a slit to which the boss is slidably coupled being formed on one side that is facing the first surface of the guide rail which is inserted into the first insertion portion, and a second insertion portion arranged side by side with the first insertion portion with a partition between the first insertion portion and the second insertion portion and through which a cover cloth covering the guide rail, to prevent the guide rail from being exposed outside, can pass through, a pressing piece rotatably coupled to an upper side of the movable member about a hinge shaft having an axial direction identical to the first direction and resiliently supported by the upper side of the movable member to be caught by and fixed to the latch, and a fixing member coupled to one side of the movable member such that the movable member is fixed to and installed in the outer overlapping portion.

5. The trousers of claim 4, wherein the inner and outer overlapping portions are formed by cutting away pocket bands at both opposite sides of the trousers, respectively.

* * * * *